US006348894B1

(12) United States Patent
Lahti

(10) Patent No.: US 6,348,894 B1
(45) Date of Patent: Feb. 19, 2002

(54) RADIO FREQUENCY ANTENNA

(75) Inventor: Saku Lahti, Tampere (FI)

(73) Assignee: Nokia Mobile Phones Ltd., Espoo (FI)

( * ) Notice: Subject to any disclaimer, the term of this patent is extended or adjusted under 35 U.S.C. 154(b) by 0 days.

(21) Appl. No.: 09/567,909

(22) Filed: May 10, 2000

(51) Int. Cl.[7] ..... H01Q 1/36
(52) U.S. Cl. ..... 343/702; 343/700 MS
(58) Field of Search ..... 343/702, 700 MS; 455/90, 558; 439/76.1, 500, 620

(56) References Cited

U.S. PATENT DOCUMENTS

| | | | | |
|---|---|---|---|---|
| 4,286,335 A | * | 8/1981 | Eichler et al. | 455/89 |
| 5,696,517 A | * | 12/1997 | Kawahata et al. | 343/700 MS |
| 5,711,013 A | * | 1/1998 | Collett et al. | 455/558 |
| 5,836,790 A | * | 11/1998 | Barnett | 439/620 |
| 5,929,813 A | | 7/1999 | Eggleston | 343/700 |
| 6,023,241 A | * | 2/2000 | Clapper | 342/357.13 |
| 6,124,831 A | * | 9/2000 | Rutkowski et al. | 343/700 MS |

FOREIGN PATENT DOCUMENTS

| | | |
|---|---|---|
| EP | 0623967 | 11/1994 |

* cited by examiner

*Primary Examiner*—Don Wong
*Assistant Examiner*—James Clinger
(74) *Attorney, Agent, or Firm*—Ware, Fressola, Van Der Sluys & Adolphson LLP

(57) ABSTRACT

An RF antenna having a non-planar resonating region for radiating or receiving electromagnetic waves in order to convey communication signals between two electronic devices via a radio link. The resonating region is folded into at least two sections so that the radiating surface of one section is located on a different plane from the radiating surface of the other section. In order to optimize the input impedance of the antenna, an impedance matching part connected to the resonating region is used to provide a short circuit to the resonating region. A signal conduit part is used to feed signals to the resonating region in the proximity of the impedance matching part. Preferably, the antenna is integrated into a system connector of a hand-held communication device so as to allow the hand-held device to communicate with a communication network via a radio link.

23 Claims, 9 Drawing Sheets

RADIO FREQUENCY ANTENNA

FIELD OF THE INVENTION

The present invention relates generally to an antenna for conveying communication signals in the radio frequency (RF) range and, more particularly, to an antenna operating at radio frequencies around 2.45 GHz.

BACKGROUND OF THE INVENTION

A Bluetooth system provides a communication channel between two electronic devices via a short-range radio link. In particular, the Bluetooth system operates in the radio frequency range around 2.4 GHz in the unlicensed Industrial-Scientific-Medical (ISM) band. The Bluetooth radio link is intended to be a cable replacement between portable and/or fixed electronic devices. The portable devices include mobile phones, communicators, audio headsets, laptop computers, other GEOS-base or palm OS-based devices and devices with different operating systems.

The Bluetooth operating frequency is globally available, but the permissible bandwidth of the Bluetooth band and the available RF channels may be different from one country to another. Globally, the Bluetooth operating frequency falls within the 2400 MHz to 2497 MHz range, corresponding to a wavelength range of 120 mm to 125 mm in free space. In free space and for a ¼λ antenna, the physical length of the radiating element for a Bluetooth antenna is equal to the electric length of 30 mm to 31.25 mm. But when the antenna is installed in a device, the relative permittivity of the materials surrounding the antenna greatly reduces the physical length of the radiating element.

Even with a radiating element shorter than 30 mm, integrating such an RF antenna into an electronic device remains a major challenge in the design of the device. The antenna needs some space around it in order to operate properly. The antenna cannot be enclosed inside the chassis of the device. Furthermore, the RF components related to the antenna must be properly shielded from other electronic components of the device.

Presently, small-sized radio-frequency antennae are designed based on a planar configuration. For example, European Patent Application 0 623 967 A1 discloses a planar antenna operating in the 915 MHz band. This antenna consists of an L-shaped planar resonator part, a feed pin and a grounding pin joining the resonator part at one end thereof. U.S. Pat. No. 5,929,813 discloses an antenna which is operating in the frequency range of 824 MHz–894 MHz and is constructed from a single sheet of conducting material. While the above-described planar antennae are useful for their intended purposes, they are difficult to be integrated into a portable device such as a communicator device which operates in both the cellular frequency and the Bluetooth frequency.

It is advantageous and desirable to provide a small antenna so that it can be integrated into small electronic devices such as mobile phones, communicators and miniaturized audio headsets to provide a radio link in the Bluetooth band and other radio frequency bands.

SUMMARY OF THE INVENTION

The radio frequency (RF) antenna, according to the present invention, includes a non-planar resonating region made from an electrically conducting material for radiating or receiving electromagnetic waves. In a non-planar configuration, the resonating region is folded such that the main radiating surface of the antenna consists of at least two sections located in different planes. This is in contrast to a planar configuration where the main radiating surface of the antenna is located substantially on the same plane. Because the main radiating surface is folded into sections, the size of the antenna is greatly reduced, allowing the antenna to be integrated into mobile phones, communicators or other miniaturized electronic devices.

The resonating region has an electric length substantially equal to one quarter of the wavelength of interest in free space. To be used in a Bluetooth device having a radio link operating at approximately 2.45 GHz, the electric length of the radiating element is approximately 30.6 mm. However, the physical length of the radiating element is approximately 21 mm, depending on the relative permittivity of the materials surrounding the radiating element.

Preferably, the antenna also includes a feeding region coupled to the resonating region for impedance matching. The feeding region includes a feed pin and a grounding pin joining the resonating region at one end thereof. As the resonating region is used to radiate or receive electromagnetic waves carrying communication signals or messages, the feed pin which is joined to the resonating region at a feed point serves as a signal conduit between the resonating region and the RF processing components in the device. The grounding pin which is joined to the resonating region at the proximity of the feed point is used to match the input impedance of the antenna which is typically 50Ω.

Preferably, the antenna is mounted on a printed-circuit board (PCB) with the resonating region seated on a plastic block. In a mobile phone or a communicator, it is preferred that the antenna is mounted on the system connector adjacent to the bottom connector pins. The grounding pin and the feed pin can be produced by splitting an extended portion of the resonating region, but they can also be part of the circuit on the PCB.

The antenna, according to the present invention, will become apparent upon reading the description taken in conjunction with FIGS. 1–9.

DETAILED DESCRIPTION

Figure 1:
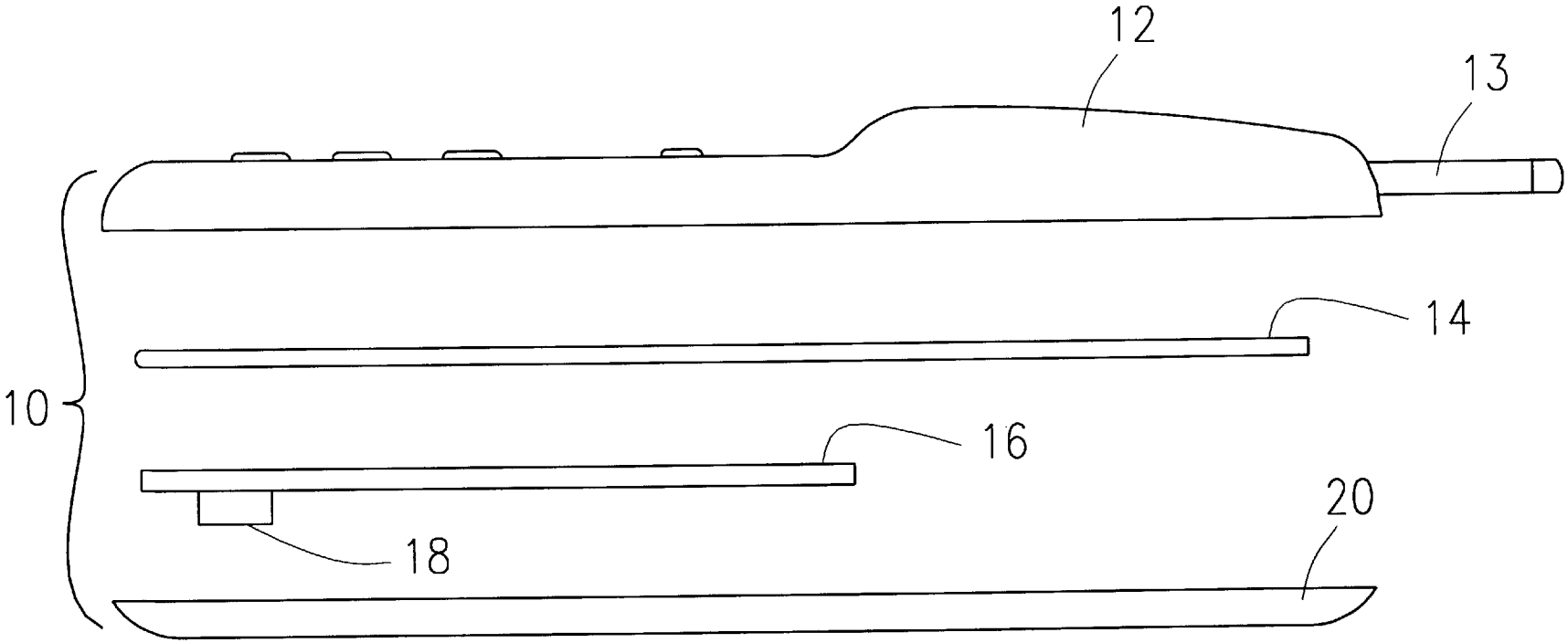
FIG. 1 is an exploded view of a mobile phone or communicator showing the preferred location of the RF antenna of the present invention, in relation to other parts of the portable device.

As shown in FIG. 1, reference numeral 10 denotes a mobile phone or a communicator having a front portion 12, a telephone antenna 13, a chassis 14, a printed-circuit board (PCB) 16 including a system connector 18, and a back cover 20. It is preferred that the RF antenna 30, according to the present invention, be mounted on the system connector 18, as shown in FIG. 2.

Figure 2:
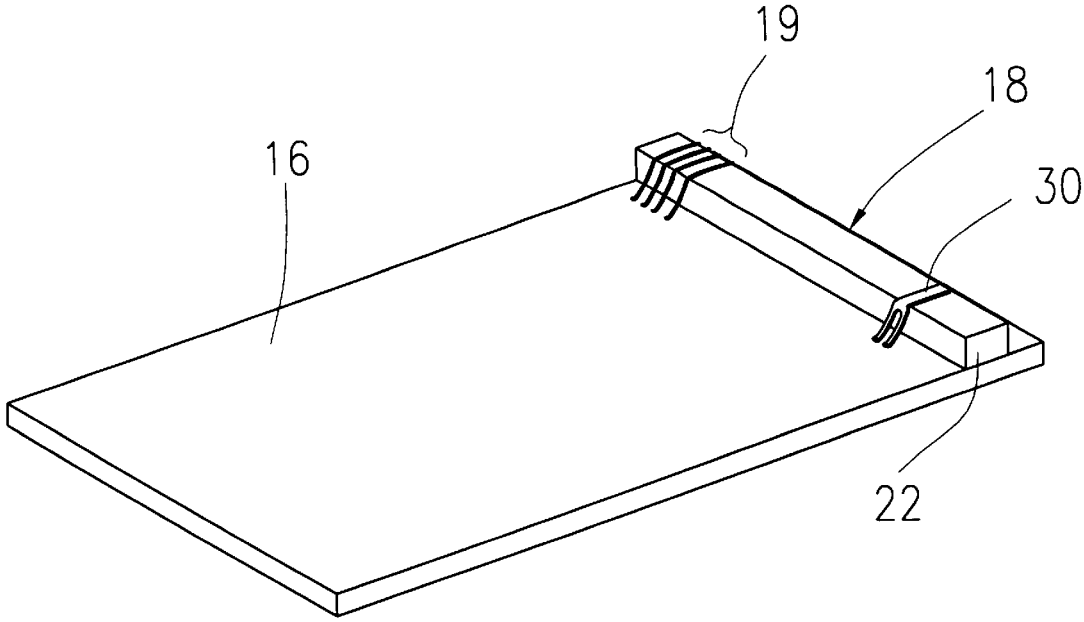
FIG. 2 is a perspective view showing the mounting of the RF antenna on the system connector.

As shown in FIG. 2, the system connector 18 consists of a block 22 of electrically non-conducting material, such as plastic, for mounting the RF antenna 30 along with other bottom connector pins 19. It is essential that the installation of the antenna 30 takes into account the bottom connector pins 19. It is preferred that the bottom connector pins 19 are kept an adequate distance from the antenna 30, and they do not resonate near the resonant frequency of the antenna 30. It is also beneficial to terminate the bottom connector pins 19 with a rather large impedance, such as 500Ω or higher.

Figure 3A:
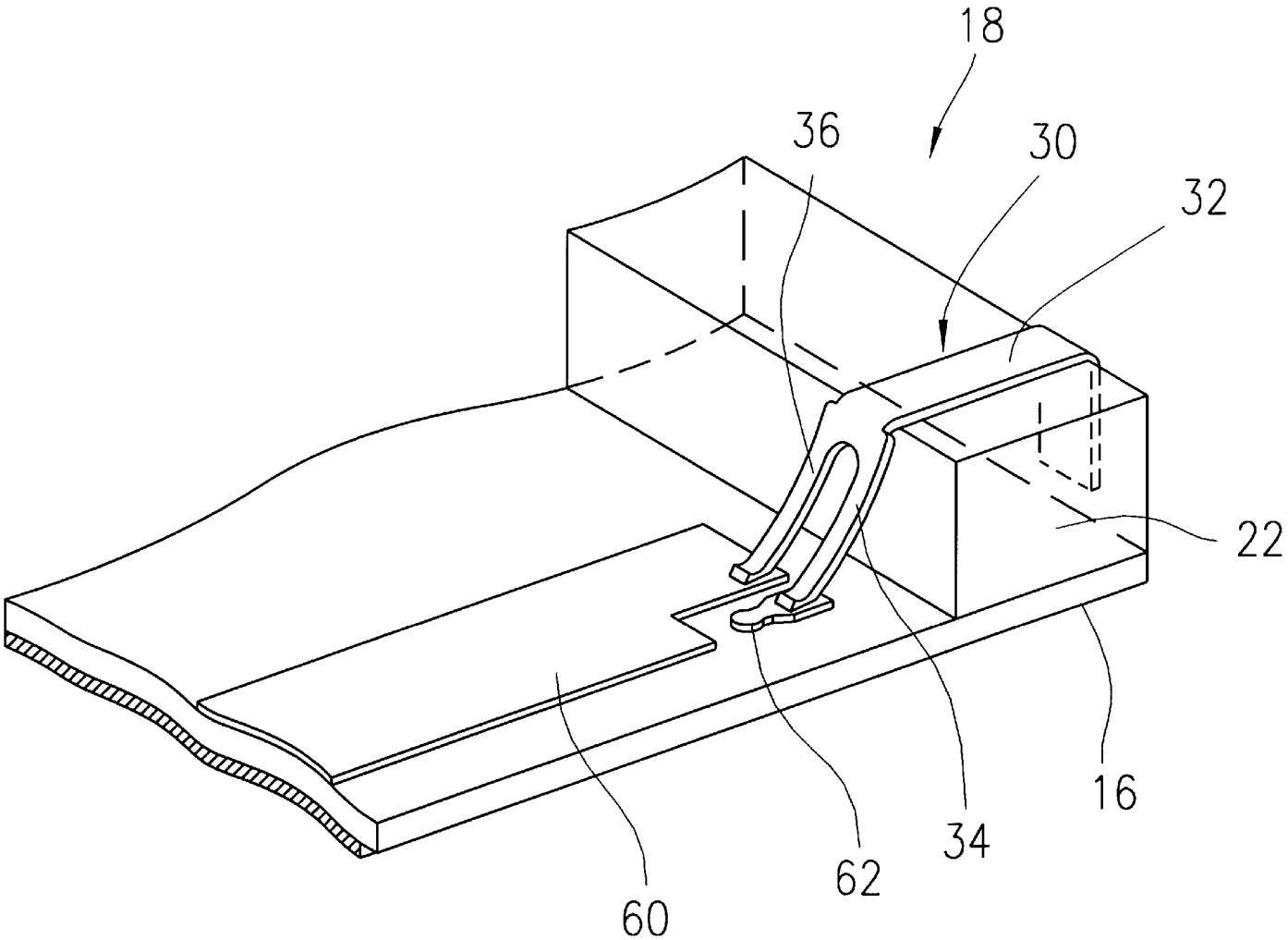
FIGS. 3*a* and 3*b* are perspective views showing the details of the antenna, according to the preferred embodiment of the present invention.
Figure 3B:
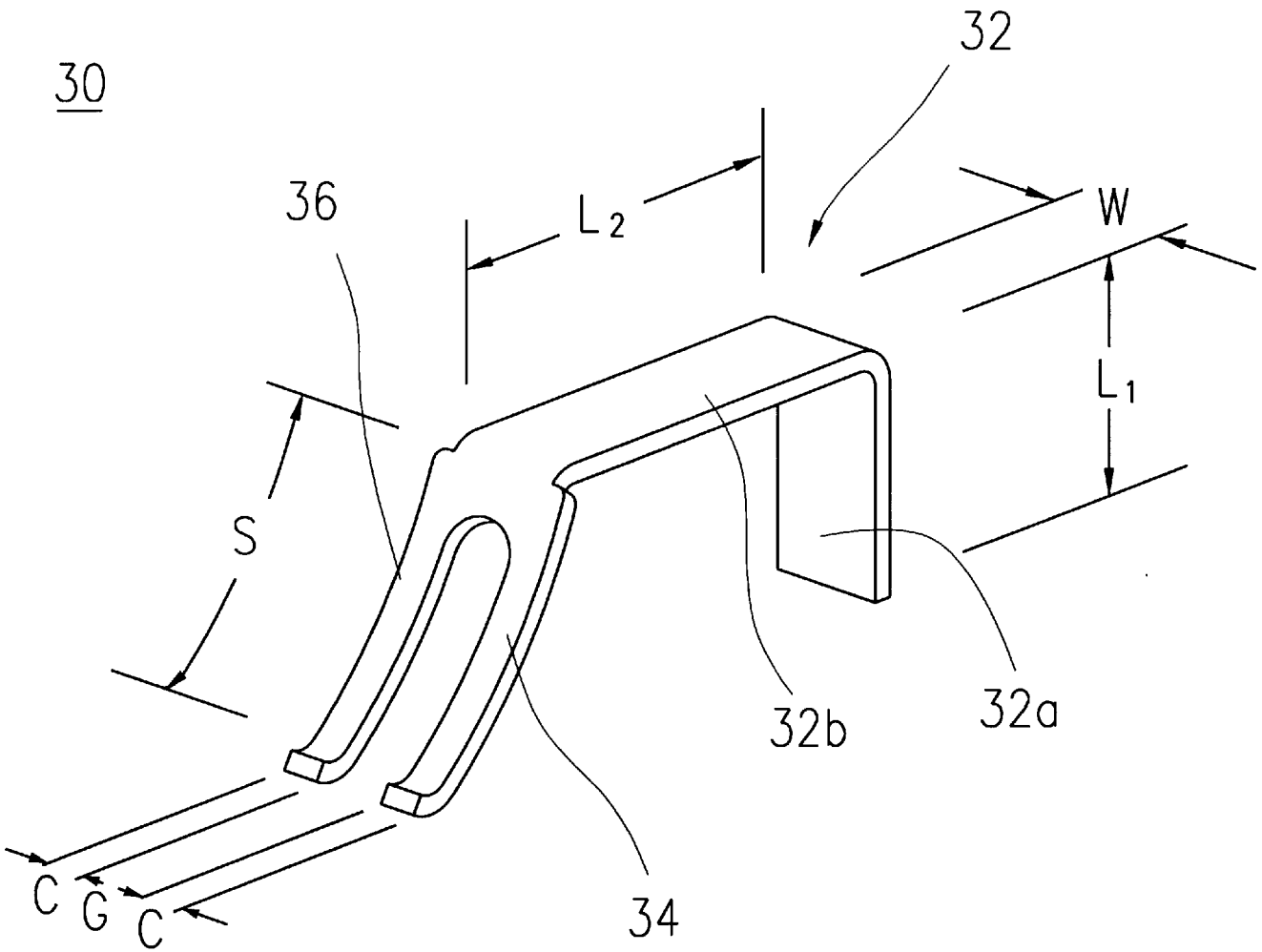
Figure 4:
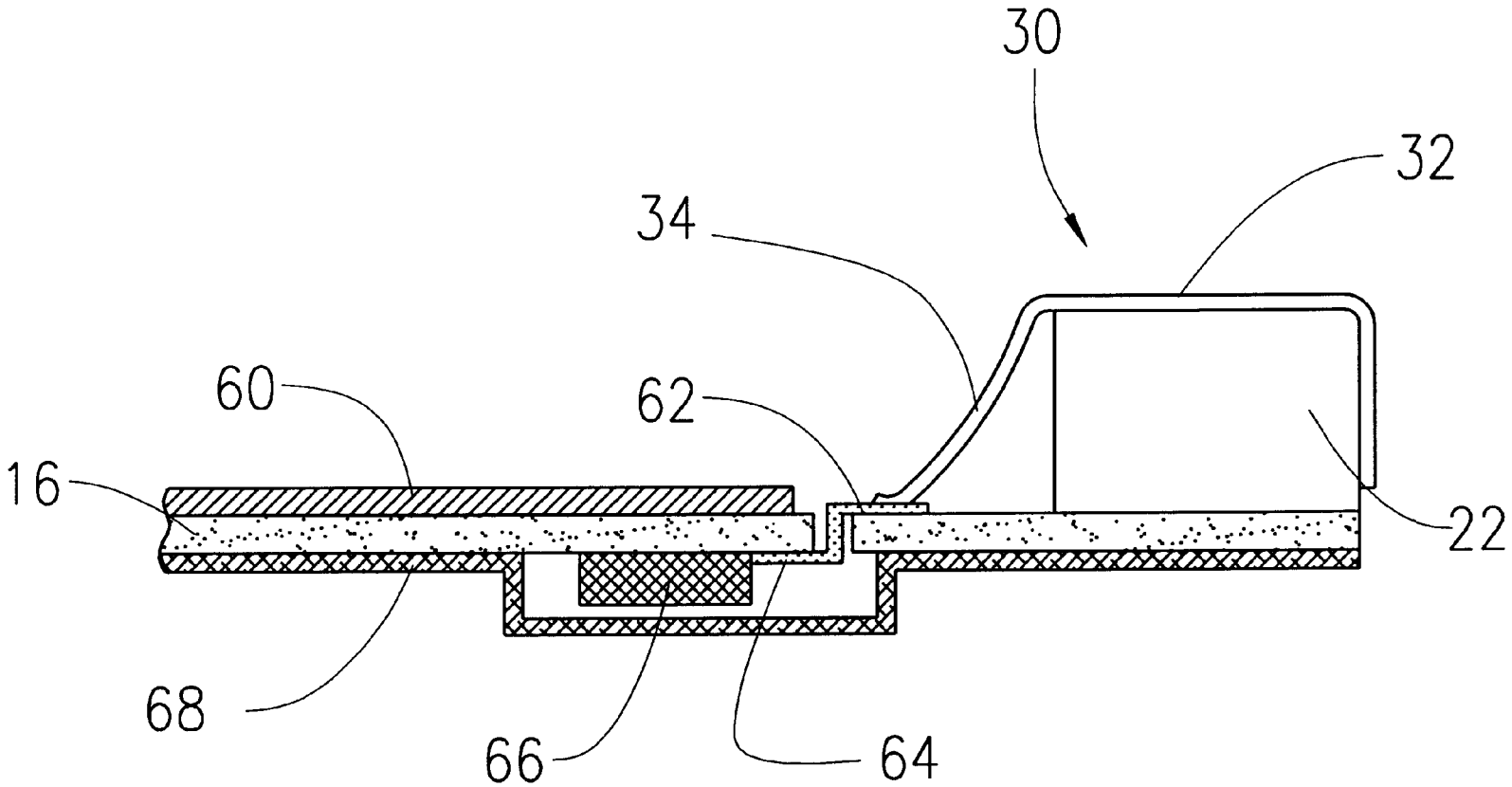
FIG. 4 is a diagrammatic sectional view of the PCB showing the installation of the antenna on the PCB.

FIGS. 3*a* and 3*b* illustrate the preferred embodiment of the present invention. As shown in FIG. 3*a,* the antenna 30, which is mounted on the plastic block 22, comprises a resonating region 32, a signal conduit part 34 and an impedance matching part 36. As shown in FIG. 3*a,* the main radiating surface of the resonating region 32 is non-planar in that it is folded into an L-shape so that the main radiating surface of the antenna is sectioned into two parts located in two different planes. Because of the folding of the resonating region 32, the input impedance of the antenna 30 is less than the typical 50Ω value and the resonating region 32 is over-coupled. One way to match the input impedance of the antenna is to provide a short-circuit to the antenna 30 using a grounding pin so that the RF signal is fed to the antenna from a feed pin at a feed point that gives an optimum match to the 50Ω load. The grounding pin, which is herein referred to as the impedance matching part 36, is electrically connected to a ground plane 60. The feed pin, which is herein referred to as the signal conduit part 34, is electrically connected to a contacting pad 62 so as to connect to a feed line on the other side of the PCB 16. A diagrammatic sectional view of the PCB 16 and the components mounted thereon is shown in FIG. 4. The electrical connection between the contacting pad 62 and the signal conduit part 34, and between the matching part 36 and the ground plane 60 can be provided by soldering or simply by spring contacts.

As shown in FIG. 3*b,* the resonating region 32 is folded into two parts 32*a,* 32*b*. The length of part 32*a* is denoted by L1, while the length of part 32*b* is denoted by L2. If the resonating region 32 is used as a radiating element in free space, then its length is equal to one quarter of the operating wavelength, or $\lambda/4$ (the electric length). With the operating frequency around 2.45 GHz, the electric length is approximately equal to 30.6 mm. However, because of the presence of the PCB 62, the ground plane 60, the plastic block 22 and the back cover 20, the physical length L1+L2 of the resonating region 32 is much less than the electric length of 30.6 mm. Typically, the physical length is reduced to approximately 21 mm due to the relative permittivity (and the loss tangent) of these surrounding materials. The width, W, of the main radiating surface of the resonating region 32 is typically 2 to 4 mm. The width C of the signal conduit part 34 and the matching part 36 can be about 1 mm and the gap G therebetween can be about 3 mm. The length S can be about 8 mm.

It should be noted, however, that the dimensions of the various parts of the antenna 30 depend on the relative permittivity of the materials around the antenna 30, the placement of the ground plane 60 and the shape of the resonating region 32. It is understood that those dimensions should be adjusted to obtain the optimized efficiency of the antenna 30.

Furthermore, the antenna 30 as shown in FIGS. 3*a* and 3*b* is divided into the resonating region 32 and a feeding region having a signal conduit part 34 and an impedance matching part 36. It should be understood that the entire antenna 30 acts as a resonator. However, the main radiating part of the antenna 30 is the main surfaces of the resonating region 32.

FIG. 4 is a diagrammatic sectional view of the PCB 16 showing the installation of the antenna 30 thereon. As shown, the contacting pad 62 is electrically connected to a feed line 64 and an RF processing device 66, which generates radio frequencies containing communication signals and processes communication signals received from other electronic devices through the antenna 30. Preferably, a shielding enclosure 68 is placed around the RF processing device 66 to minimize the effects of RF frequencies on other electronic components of the device 10.

Figure 5:
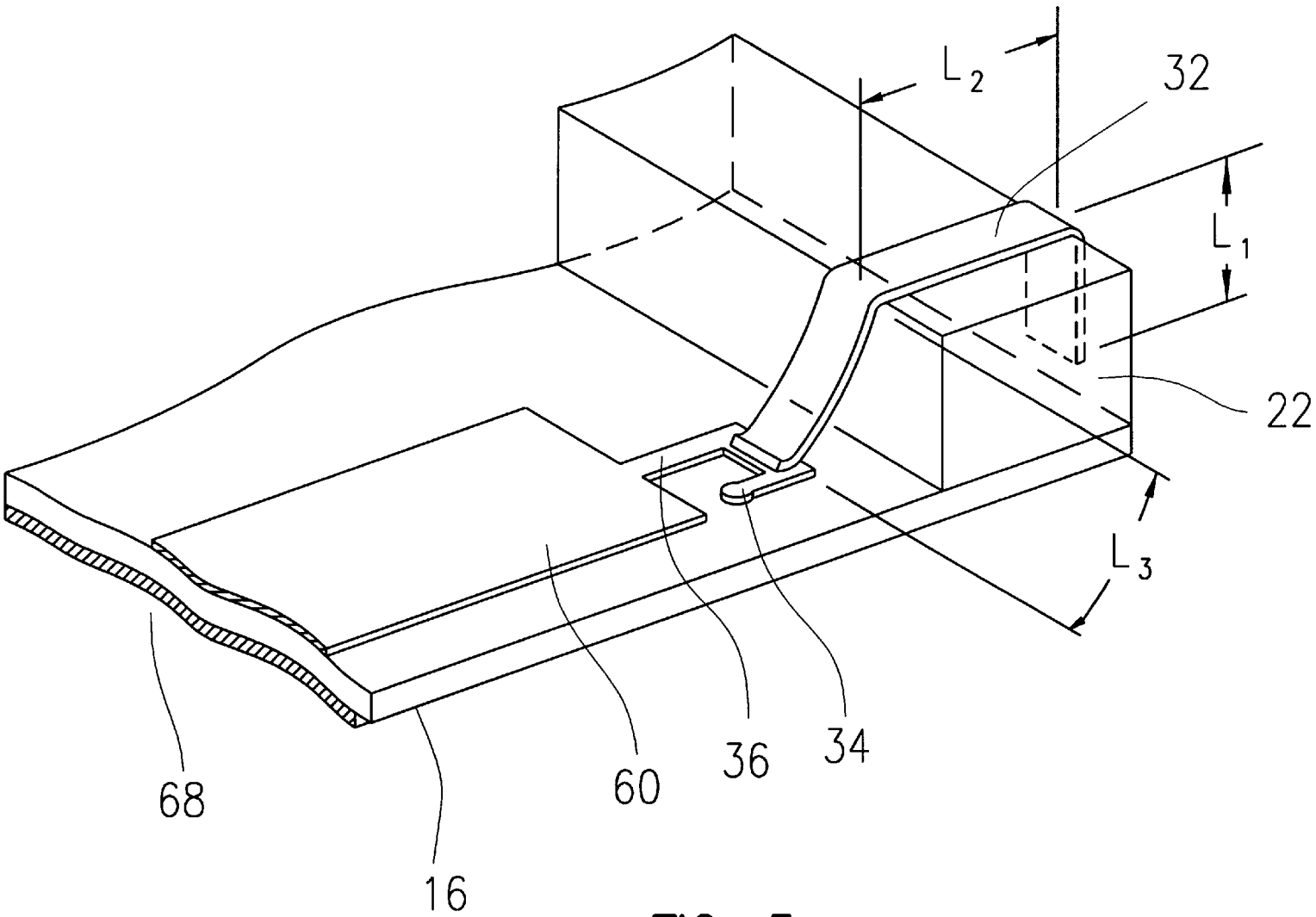
FIG. 5 is a perspective view showing another embodiment of the present invention, wherein the feeding pin and the grounding pin are implemented on the PCB.

FIG. 5 shows another embodiment of the present invention. As shown, the signal conduit part 34 and the impedance matching part 36 are directly provided on the PCB 16. The resonating region 32 can be folded into three sections as shown, but it can be also folded into two or four or more sections. The physical length of the resonating part 32, or the sum of L1, L2 and L3, as shown, is about 21 mm. It should be noted that, because the folding of the resonating part 32 shown in FIG. 5 is different from that shown in FIGS. 3*a* and 3*b,* the input impedance of the antenna 30 may also change. Thus, the dimensions of the signal conduit part 34 and the matching part 36 may require proper adjustments.

Figure 6:
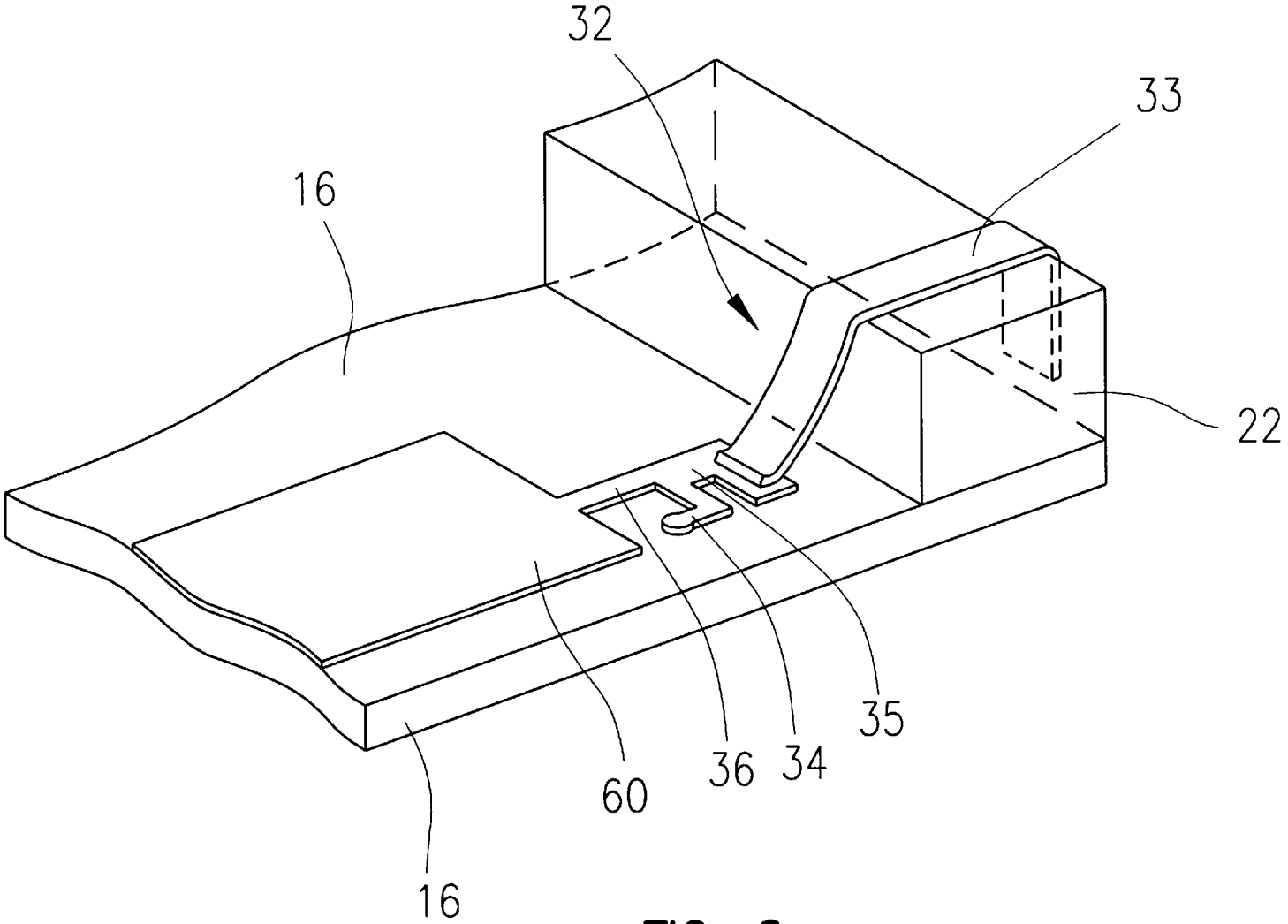
FIG. 6 is a perspective view showing yet another embodiment of the present invention, wherein a part of the radiating element is implemented on the PCB.

Alternatively, a section of the resonating region 32 can also be implemented on the PCB 16 as shown in FIG. 6. As shown, the resonating region 32 comprises a lower section 35 and an upper section 33. The lower section 35 can be produced along with the ground plane 60, the matching part 36, and the signal conduit part 34 on the PCB 16, and then electrically connected to the upper section 33 by soldering or with a spring contact.

Figure 7:
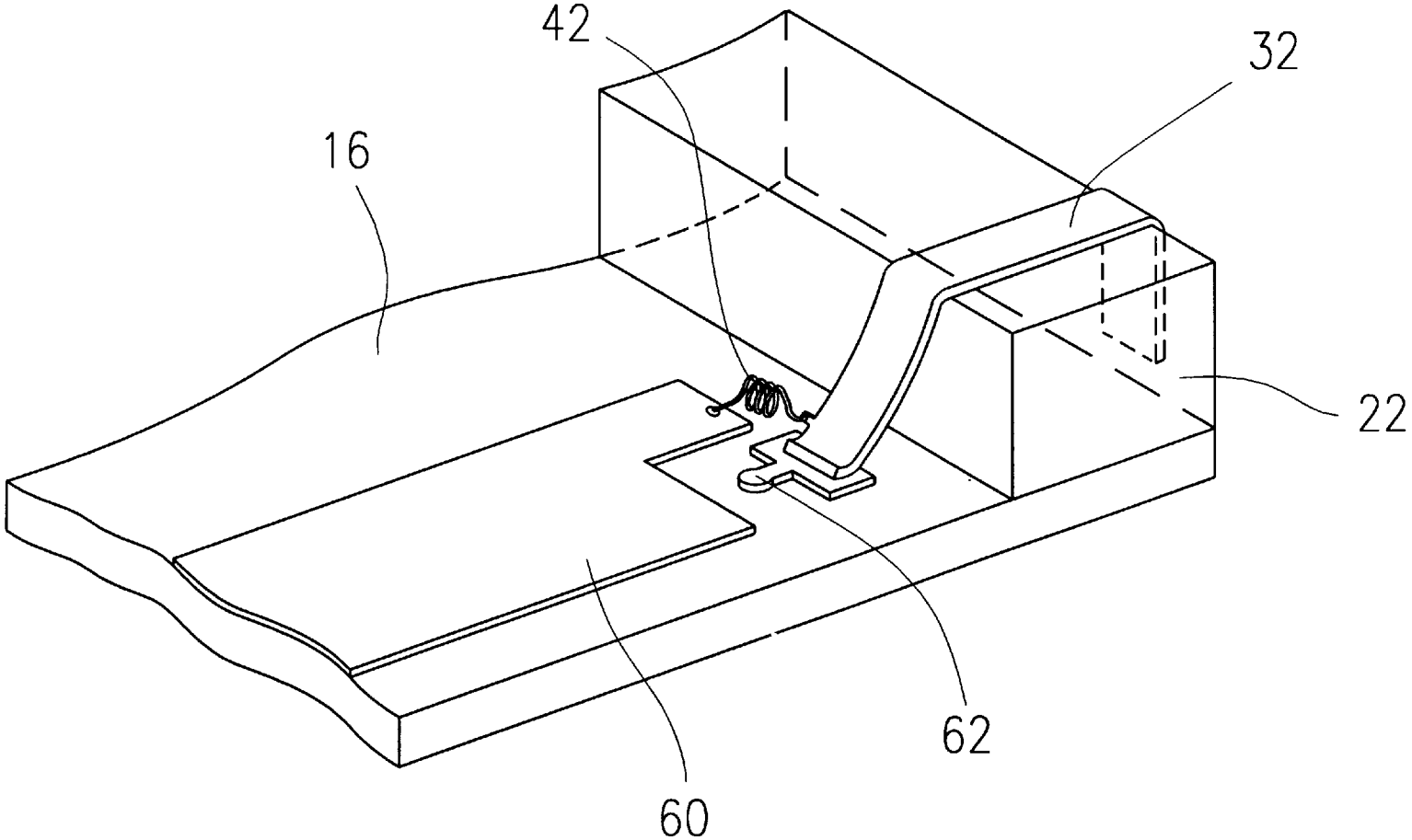
FIG. 7 is a perspective view showing an alternative way to match the input impedance of the antenna.

As shown in FIGS. 1 to 6, impedance matching is carried out by grounding the resonator at one end of the resonating region 32 using a grounding pin (the matching part 36). Alternatively, the impedance matching can be carried out by using an inductive element connected to the resonating region 32 as shown in FIG. 7. As shown in FIG. 7, an inductor chip or coil 42 is used to connect between the resonating region 32 and the ground plane 60.

Figure 8:
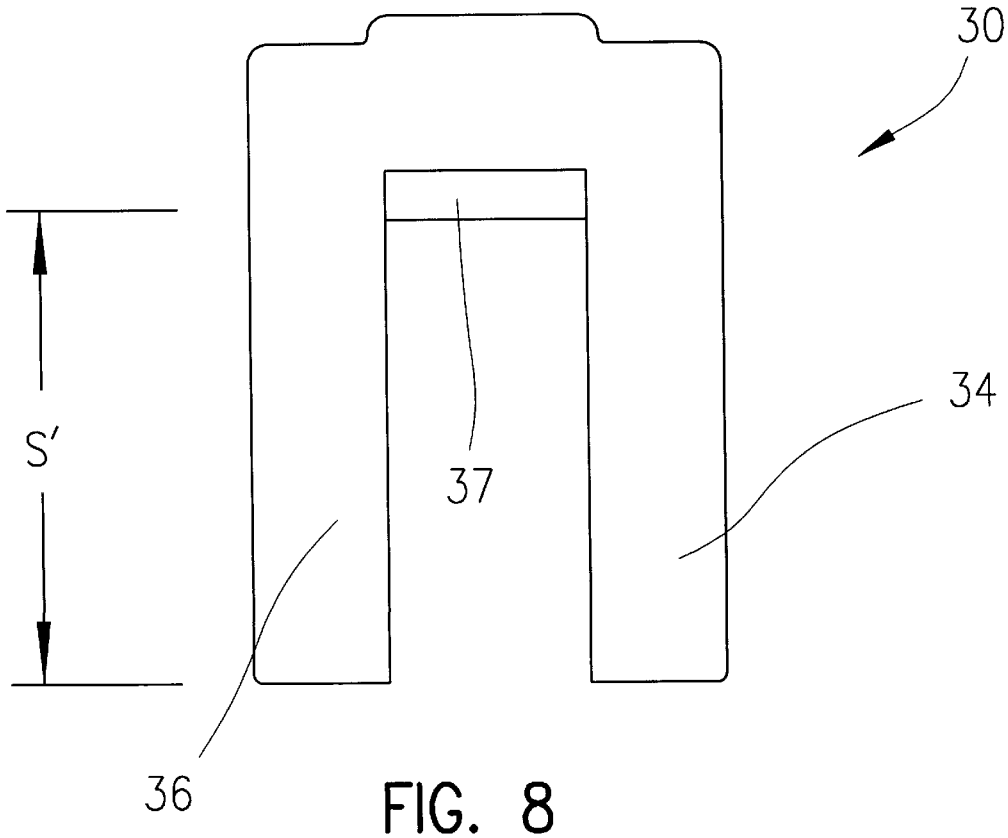
FIG. 8 is a schematic representation showing an adjustable slot between the grounding pin and the feeding pin.

It should be noted that the geometry of the antenna 30 can be altered in order to optimize the impedance matching. For example, the gap G between the signal conduit part 34 and the matching part 36 can be widened or narrowed in order to accomplish an optimum impedance matching. Alternatively, the slot length S' of the gap G can be adjusted for optimum matching. As shown in FIG. 8, the slot length S' can be adjusted by removing a tab 37 from the slot or adding another tab to the slot.

Figure 9:
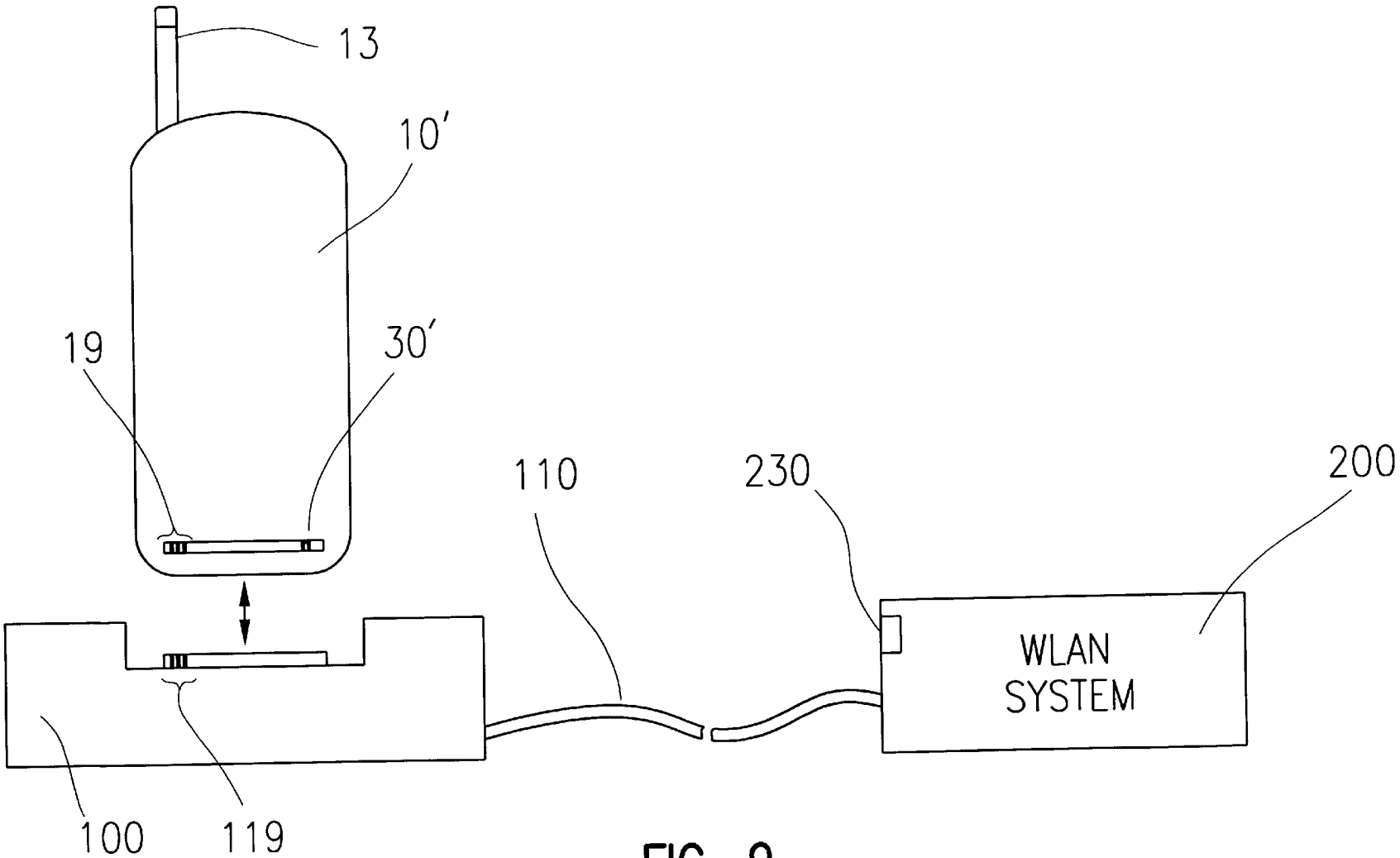
FIG. 9 is a schematic representation showing a wireless device with a WLAN antenna for communicating with other devices in a WLAN system.

FIG. 9 is a diagrammatic representation of a Wireless Local Area Network (WLAN) system 200. As shown, the WLAN system 200 is coupled to a connector cradle or laptop stand 100 via a cable 110. The WLAN system 200 is equipped with a WLAN antenna 230 so that it can communicate with a wireless device in radio frequencies. In FIG. 9, reference numeral 10' denotes a hand-held device such as a mobile phone or a communicator which is also equipped with a WLAN or Bluetooth antenna 30' on the system connector (plastic block 22, FIG. 2). The hand-held device also has a group of bottom connectors 19. The laptop stand 100 has a slot 108 to allow the hand-held device 10' to be plugged in the laptop stand 100. The laptop stand 100 further includes a group of matching pins 119. When the hand-held device 10' is plugged in the laptop stand 100, the bottom connectors 19 and the matching pins 119 are electrically coupled to convey signals. Thus, when the hand-held device 10' is plugged in the laptop stand 100, it can communicate with the WLAN system 200 via the cable 110. Accordingly, the hand-held device 10' can be physically and electrically coupled to the laptop stand 100 in order to communicate with the WLAN system 200 using a packet switching (PSTN, for example) or a circuit switching (IP, for example) method. Alternatively, the hand-held device 10' can be logged on to the WLAN system 200 in a wireless fashion via the WLAN antenna 230 of the WLAN system 200 and the WLAN antenna 30' of the hand-held device 10', without the hand-held device 10' being connected to the laptop stand 100. Preferably, the WLAN antennas 230 and 30' are operating at a radio frequency range of 2.4–2.5 GHz, or another frequency range around 5.6 GHz.

Thus, the present invention has been disclosed in the preferred embodiments as depicted in FIGS. 1 through 9. The resonating region of the antenna has been disclosed as a non-planar radiating element wherein the main radiating surface is folded along the plastic block on which the antenna is mounted. However, the non-planar resonating region can be made into a different folding pattern. The resonating region can also be made to have a twisted section or a different shape. Also, the dimensions of various parts of the antenna can be changed to match the relative permittivity (and the tangent loss) of the antenna environment. Furthermore, the present invention has been disclosed in regard to the Bluetooth operating frequencies around 2.45 GHz and the WLAN operating frequencies around 5.6 GHz. However, the same embodiments can be scaled up or down so as to allow the antenna to operate at a different frequency.

Therefore, although the invention has been described with respect to a preferred embodiment thereof, it will be understood by those skilled in the art that the foregoing and various other changes, omissions and deviations in the form and detail thereof may be made without departing from the spirit and scope of this invention.

What is claimed is:

1. An antenna operating in the radio frequency range to be used in a hand-held communication device having a system connector, said radio frequency antenna comprising:

a resonating region to radiate or receive electromagnetic waves carrying the communication signals; and a feeding region coupled to the resonating region for impedance matching, wherein the radio frequency antenna is integrated into the system connector so as to allow the hand-held communication device to communicate with a communication network via a radio link.

2. The radio frequency antenna of claim 1, wherein the hand-held communication device has a first end for placing a telephone antenna and an opposing second end for placing the system connector so as to physically separate the radio frequency antenna and the telephone antenna.

3. The radio frequency antenna of claim 1, wherein the radio link is operating in a Bluetooth frequency range.

4. The radio frequency antenna of claim 1, wherein the radio link is operating in a WLAN frequency range.

5. The radio frequency antenna of claim 1, wherein the communication network comprises a WLAN system.

6. The radio frequency antenna of claim 1, wherein the communication network comprises a connection device which is physically linked to the communication network for conveying signals, and said connection device has means to make electrical contact to the system connector of the hand-held communication device so as to allow the hand-held device to optionally convey signals to or from the communication network in a wired fashion.

7. The radio frequency antenna of claim 6, wherein signals are conveyed to or from the communication network in a packet switch mode or a circuit switch mode in the wired fashion.

8. The radio frequency antenna of claim 1, wherein the resonating region is non-planar, wherein the non-planar resonating region is folded into at least two sections located in two different but intersecting planes, and wherein the hand-held communication device includes an electronic processor to process the communication signals, and the feeding region comprises a signal conduit part to convey the communication signals between the resonating region and the electronic processor.

9. The radio frequency antenna of claim 8, wherein the hand-held communication device further includes a signal ground and the resonating region has an input impedance, and wherein the feeding region comprises an impedance matching part electrically connected to the signal ground in order to match the input impedance.

10. The radio frequency antenna of claim 9, wherein the signal conduit part and the impedance matching part are joined to the resonating region at one end thereof.

11. The radio frequency antenna of claim 9, wherein the impedance matching part comprises a strip of electrically conducting material.

12. The radio frequency antenna of claim 9, wherein the impedance matching part comprises an inductive element.

13. The radio frequency antenna of claim 12, wherein the inductive element comprises a coil inductor.

14. The radio frequency antenna of claim 12, wherein the inductive element comprises a chip inductor.

15. The antenna of claim 9, wherein the impedance matching part is implemented on a printed-circuit board.

16. The antenna of claim 9, wherein the signal conduit part is implemented on a printed-circuit board.

17. The antenna of claim 9, wherein the resonating region comprises a first section made directly on a printed-circuit board and a second section made separately from the printed-circuit board, and wherein the first section and the second section are electrically connected to provide a radiating element of the antenna.

18. The antenna of claim 9, wherein the resonating region is formed from a single strip of electrically conducting material.

19. A method of conveying communication signals in a radio frequency range between a hand-held communication device and another communication device, wherein the hand-held communication device has a system connector, said method comprising the steps of:

providing a non-planar resonating region to radiate or receive electromagnetic waves carrying the communication signals; and providing a feeding region coupled to the non-planar resonating region for impedance matching, wherein the non-planar resonating region is folded into at least two sections located in two different but intersecting planes, and wherein the non-planar resonating region is integrated into the system connector.

20. The method of claim 19, wherein the feeding region includes:

a signal conduit part joining the resonating region at a feed point in order to feed the communication signals to the resonating region or to retrieve the communication signals from the resonating region; and an impedance matching part joining the resonating region at the proximity of the feed point.

21. The method of claim 20, wherein the resonating region has an impedance, and the impedance matching part and the signal conduit part are separated by a slot therebetween, and wherein the gap can be widened or narrowed to change the impedance of the resonating region.

22. The method of claim 21, wherein the slot can be shortened or lengthened to change the impedance of the resonating region.

23. The method of claim 19, wherein the resonating region is folded into a plurality of sections so that each section has a radiating surface located in a plane different from the radiating surface of each other section.

* * * * *